US005295613A

United States Patent [19]

Barthomeuf et al.

[11] Patent Number: 5,295,613

[45] Date of Patent: Mar. 22, 1994

[54] TUBULAR CARTRIDGE FOR STORING AND APPLYING A NON-SOLID PRODUCT, AND A DRIVE AND THRUST ASSEMBLY FOR THE CARTRIDGE

[75] Inventors: Jean-Paul Barthomeuf, Bourg de Peage; Alain Gauthier, Tournon, both of France

[73] Assignee: Societe de Prospection et d'Inventions Techniques (S.P.I.T.), Bourg Les Valence, France

[21] Appl. No.: 910,795

[22] Filed: Jul. 9, 1992

[30] Foreign Application Priority Data

Jul. 10, 1991 [FR] France ..... 91 08689

[51] Int. Cl.[5] ..... B65D 35/22

[52] U.S. Cl. ..... 222/137

[58] Field of Search ..... 222/137, 145, 327, 386

[56] References Cited

U.S. PATENT DOCUMENTS 3,850,346 11/1974 Richardson et al. ..... 222/145

FOREIGN PATENT DOCUMENTS 10913 9/1956 Fed. Rep. of Germany ..... 222/137
3301383 7/1984 Fed. Rep. of Germany .
9102635 3/1991 Fed. Rep. of Germany .
1209359 3/1960 France .
2412475 12/1977 France .
2501080 3/1981 France ..... 222/137
2424856 4/1989 France .

*Primary Examiner*—Edwin L. Swinehart
*Attorney, Agent, or Firm*—Schwartz & Weinrieb

[57] ABSTRACT

A cartridge has a multiple casing comprising an outer casing (1) with a front end piece (2) for receiving an application nozzle and an annular rear thrust wall (4) mounted slidingly in the outer casing (1), and at least one inner casing (5) with a front end piece (6) extending inside the end piece (2) of the outer casing (1) and a disc-shaped rear thrust wall. Shoulders and ribs (8, 14, 16) for connecting the two outer (1) and inner (5) casings together ensures their mutual locking in axial and radial positions. A drive assembly is structured like the cartridge. The invention is well suited to the application of sealing resins.

20 Claims, 3 Drawing Sheets

TUBULAR CARTRIDGE FOR STORING AND APPLYING A NON-SOLID PRODUCT, AND A DRIVE AND THRUST ASSEMBLY FOR THE CARTRIDGE

FIELD OF THE INVENTION

The present invention relates to a cartridge for storing and applying a non-solid, viscous or very incidentally liquid product, comprising an outer casing with, on one side, an end piece designed to receive an application nozzle and, on the other side, an end wall designed to slide towards the end piece and push or drive the product out of the end piece and nozzle.

BACKGROUND OF THE INVENTION

Such cartridges are often used for applying resins, sealing compounds or thermal and/or sound insulation compounds.

The sliding of the end wall of the cartridge is brought about by a piston which is operated directly by hand or, more commonly, which is an integral part of a manual operating appliance, in the form of a gun, and generally with a rack or friction advance.

Some products consist of several components which must be mixed, in given proportions, only at the time of application.

It has therefore already been proposed to store these products in multiple-casing cartridges, with an outer casing and at least one internal casing, a first component being stored between the outer casing and the inner casing and a second component inside the inner casing.

FR-A-81 04213 gives details of such a double-casing cartridge. In order to maintain the relative axial position of the two casings, the viscosities of the two components not being identical, and in order to ensure the concentric arrangement of the front openings of the two casings, as well as the channelling of the component from the outer casing to the application end piece, provision is made, on the end piece side, for a spacing and connecting piece and, on the end walls side, a rear stop dish.

The present invention first aims to dispense with this spacing piece and this rear stop.

DE-A-3 301 388 also teaches a tubular cartridge for storing and applying a non-solid product having a multiple casing comprising an outer casing with a front end piece for receiving an application nozzle and an annular rear thrust wall mounted slidingly in the outer casing, and at least one inner casing with a front end piece and a disc-shaped rear thrust wall, means for connecting the two outer and inner casings being provided for ensuring their mutual locking in axial and radial positions.

But the front end piece of the inner casing of this reference does not extend inside the front end piece of the outer casing. Thus, the cartridge of this reference cannot solve the problem of applying several components to be mixed only upon application and in given proportions.

The present invention thus relates to a tubular cartridge for storing and applying a non-solid product, of this last type, characterized by the fact that the front end piece of the inner casing extends inside the front end piece of the outer casing and the means of connection comprise, on one of the two casings, at least one snap-on rib, with a front portion for snapping on and rear locking and a rear portion for front locking and, on the other one of the two casings, two shoulders arranged to interact respectively with the two front and rear portions of the rib.

The invention offers the advantage of particularly simple production and assembly of the multiple-casing cartridge. FR-A-79 10957 also discloses details of a multiple-casing cartridge which is also provided, on the inner casing, with radial bracing ribs or fins preventing the inner casing from moving forwards, that is to say towards the end piece of the outer casing, and ensuring the mutual locking of the two casings in the radial position. However, these fins do not prevent the inner casing from moving towards the rear. Moreover the cartridge is described, in this document FR-A-79 10957, with a rear stop. With this removed, the risk of a backward movement of the inner casing can therefore exist.

SUMMARY OF THE INVENTION

It will be noted that the applicant, to define tis invention, does not desire to start from the details in the latter document. As a matter of fact, nothing, in the prior art, could prompt a man skilled in the art to transform these fins for aligning and locking the casings in one direction into fins for aligning and locking the casings in both directions.

Preferably, the snap-on rib is made from rigid material, the front snap-on portion of the rib is arranged to pivot elastically and be pushed towards the wall of its casing and the rear portion of the rib has a locking lug.

Advantageously, the snap-on rib is integral with the outer casing.

In an interesting embodiment, the front end piece of the inner casing is tubular in cross-sectional configuration, wherein the tubular portion is semi-circular or D-shaped as seen in cross-section.

Actually, the multiple casing of the cartridge of the invention can have been the outer casing with an annular rear thrust wall and the inner casing with a disc-shaped rear thrust wall, at least one secondary inner casing with a rear annular thrust wall, forming an inner casing for the outer casing and an outer casing for the inner casing, the casings being connected in pairs, advantageously snapped onto each other.

The invention also relates to an assembly for driving the rear thrust walls for the outer and inner casings of the multi-casing cartridge of the invention, or more generally any multiple-casing cartridge with at least one inner casing, comprising an annular outer piston, for the annular wall, and at least one disc-shaped inner piston, for the disc-shaped wall, the two pistons being integral in translation, an assembly characterized by the fact that the two pistons are respectively associated with two outer and inner tubular transmission devices secured together, advantageously snapped onto to each other.

Preferably, the two transmission devices are mutually locked in axial and radial positions, like the cartridge casings.

By actuating one of the two transmission devices, preferably the outer device associated with the annular piston, it is possible by means of the driving assembly of the invention, to use the cartridge of the invention with a conventional commercial gun and its single disc-shaped piston provided for a single-casing cartridge of a length substantially equal to the sum of the lengths of the cartridge and the driving assembly of the invention.

BRIEF DESCRIPTION OF THE DRAWINGS

The invention will be understood better by means of the following description of several embodiments of the cartridge and of the driving assembly of the invention, with reference to the accompanying drawings, in which like reference characters designate like or corresponding parts throughout the several views, and wherein.

DETAILED DESCRIPTION OF THE ILLUSTRATED EMBODIMENTS

Figure 2A:
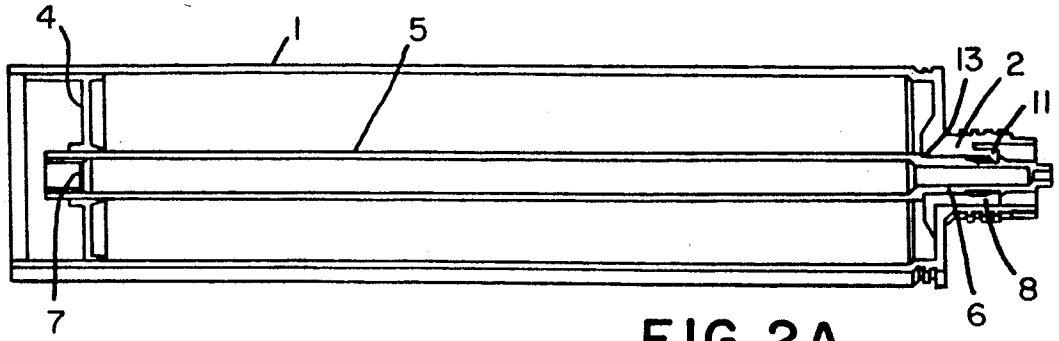
FIGS. 2A and 2B show (FIG. 2A) the cartridge of FIG. 1, in the same representation and on a smaller scale, in association with (FIG. 2B) the appropriate driving assembly.
Figure 2B:
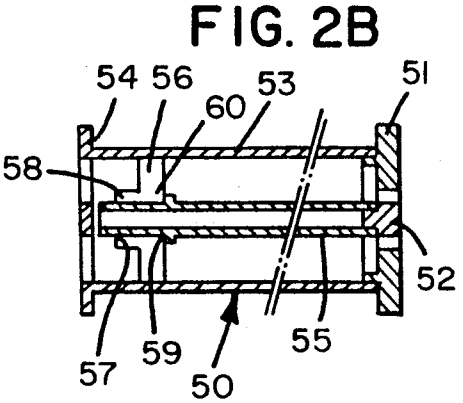
Figure 3:
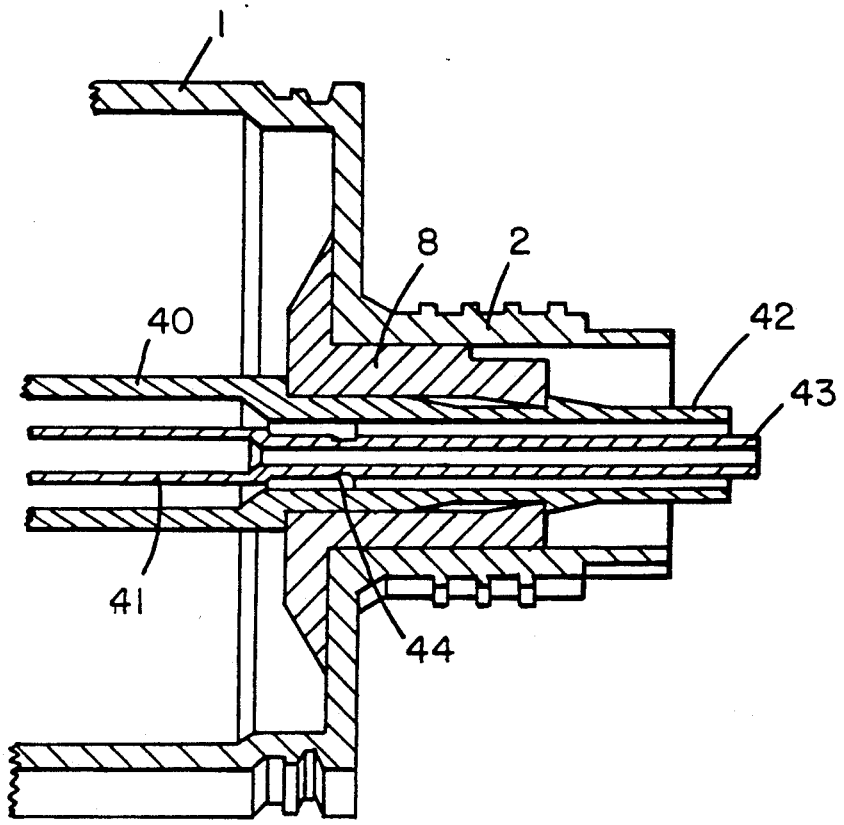
FIG. 3 is a partial cross-sectional view, similar to that of FIG. 1, of the cartridge of the invention with a triple casing.

The cartridges of FIGS. 1, 2, 4 and 5 have a double casing, while the one in FIG. 3 has a triple casing. In each case it is a question of storing several non-solid constituents, in this case two or three, which have to be mixed, at the time of application, in predetermined proportions and which are dependent on the surfaces of the annular or disc-shaped rear thrust walls of the casings to dispense such constituents from the casings.

Figure 1:
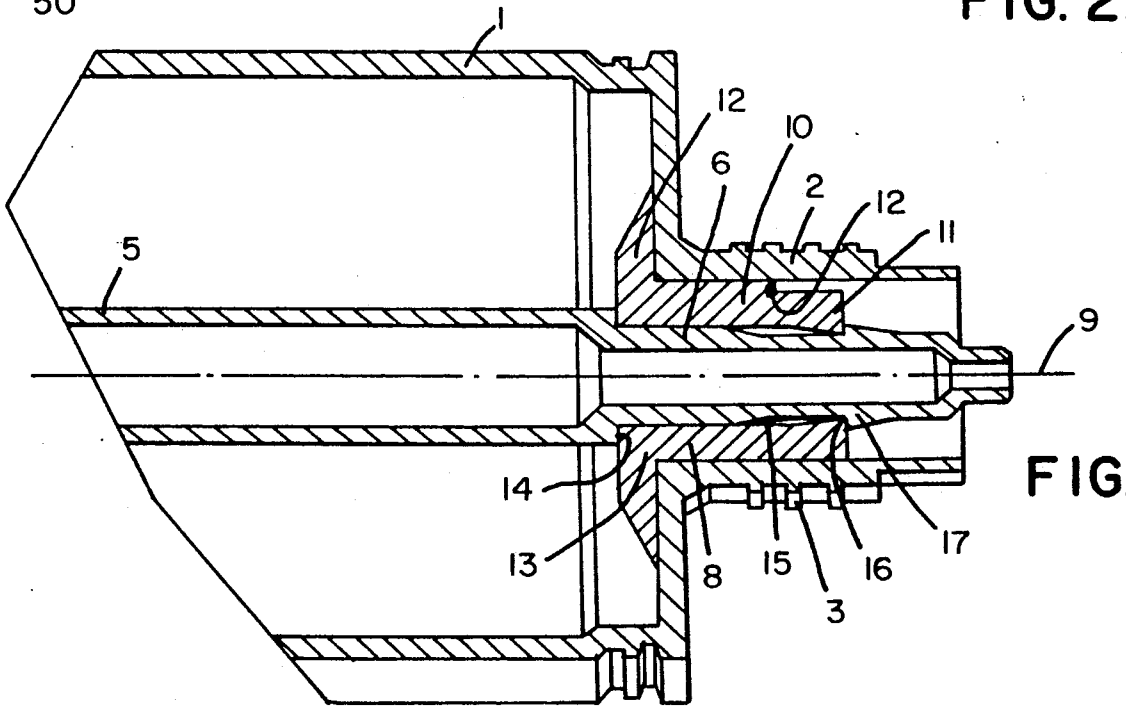
FIG. 1 is a partial view of the cartridge of the invention, with a double casing, partly in axial section and partly in perspective.

The cartridge of FIGS. 1 and 2A has a first outer tubular casing 1, with a threaded front end piece 2 (thread 3), for receiving an internally tapped application nozzle, not shown, and an annular rear sealing and thrust wall 4, mounted so as to slide in the casing 1. The cartridge has a second inner tubular casing 5 with a front end piece 6 extending inside the end piece 2 of the outer casing 1 and a disc-shaped rear sealing and thrust wall 7 mounted so as to slide in the casing 5.

The two casings 1, 5 are connected, in this case snapped into each other, and mutually locked axially and radially.

The outer casing 1 has, on the inside, in this case four rigid ribs 8, moulded in one piece with the casing, disposed substantially in two perpendicular planes passing through the axis 9 of the cartridge and in diametrically opposite pairs. The ribs 8 lie in the area in which the end piece 2 is connected to the body, which has a larger diameter, of the casing 1 and each have a front portion 10, provided with a snap-on catch 11 projecting slightly towards the axis 9, and a rear L-shaped portion 12 with a locking claw 13 disposed slightly further away from the axis 9 than the snap-on catch 11. The snap-on catch 11 is not rigidly secured to the internal wall of the end piece 2; it has a degree of radial freedom so as to be able to undergo a slight elastic deflection and be pushed towards the internal wall of the casing 1. A small rounded cut-out is provided in the area of bending of the front portion 10 of the ribs 8 in order to avoid any tearing.

The inner casing 5 has, in the are where its body with a larger diameter is connected to its end piece 6, an external annular shoulder 14 for receiving the claws 13 on the ribs 8 of the outer casing 1, and the end piece 6 has an external peripheral recess 15 with, towards the front, an external annular shoulder 16 formed with an annular bulge 17 and opposite the other shoulder 14, for receiving the snap-on catches 11 on the ribs 8 on the outer casing.

In order to install the inner casing 5 in the outer casing 1, the inner casing 5 is inserted, by means of its end piece 6, into the outer casing 1, through the rear of the latter, and then the end piece 6 is inserted into the end piece 2. By means of a simple axial thrust, the bulge 17 passes the catches 11 by causing them to pivot and by pushing them towards the internal wall of the end piece 2 and, when the shoulder 14 comes in abutment against the claws 13, thus locking the inner casing 5 radially and towards the front, the catches 11, through their elasticity, become free again to resume their natural position, in the annular shoulder 16, in order to lock the inner casing 5 radially also and towards the rear.

Figure 5:
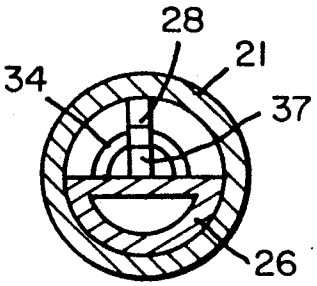
FIG. 5 is a view in section along the line 5—5 of FIG. 4.
Figure 6:
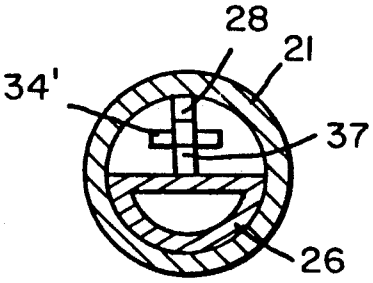
FIG. 6 is a view similar to that of FIG. 5, with a variant embodiment of the front locking stop of the inner casing.
Figure 4:
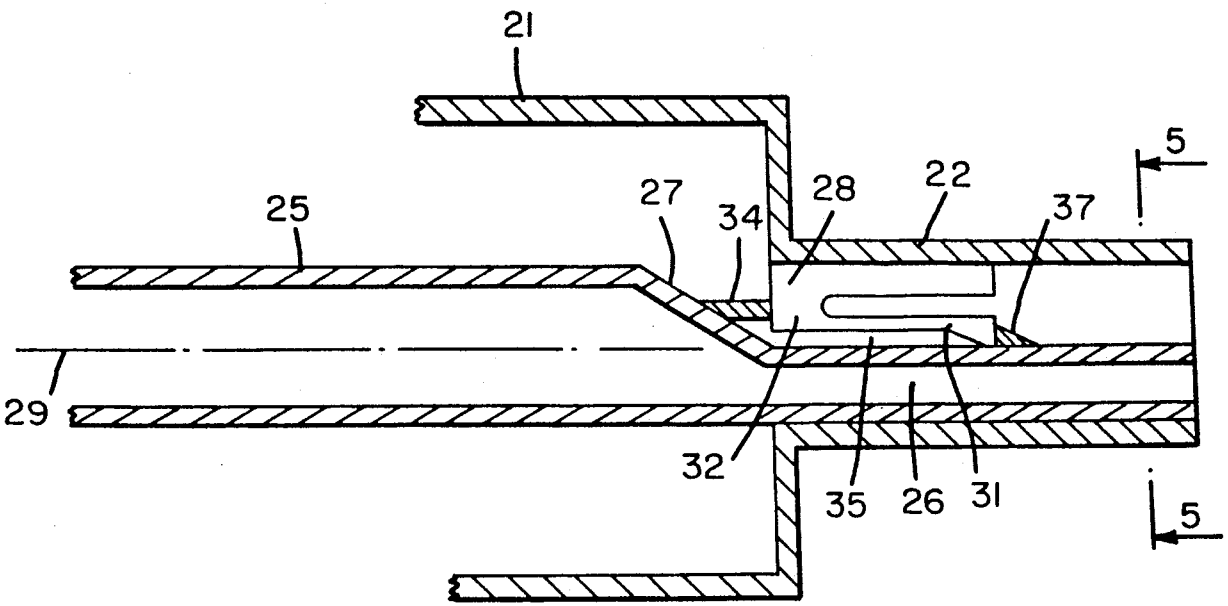
FIG. 4 is a partial view in axial section, more in outline, of the cartridge of the invention with a tubular inner casing having a substantially D-shaped cross-sectional configuration.

In the embodiment of FIGS. 4, 5, the outer casing 21, with tis end piece 22, contains an inner casing 25 with a tubular front end piece 26 which has a substantially D-shaped configuration as seen in cross-section, with an external diameter equal to the internal diameter of the end piece 22. In this case, the outer casing 21 has only a single snap-on rib 28, in a diametral plane, with the same internal half diameter as the overall height, in the form of a C with two arms, of which the art 31, the closest to the axis 29, providing with the endpiece 26 a space 35 and connected elastically to the other, serves as a snap-on catch. The end piece 26 has only one diametral bulge 37 for the rear locking of the inner casing 25. The end piece 26 is connected to the body of the inner casing 25 by a tapered portion 27 carrying a stop 34 for the front locking of the rib 278 of the casing 21 against the rear claw 32. The stop 34 can be a semi-circular rib, as in FIG. 5, or flat, 34, as in FIG. 6.

It will be noted in this case that the cartridge of FIGS. 1, 2A has four snap-on ribs, and the cartridge of FIGS. 4, 5, only one. In the case of two completely tubular outer and inner casings, four ribs are not absolutely essentially but it is desirable for there to be at least two, preferably at least three.

Likewise, outer casings provided with snap-on ribs and inner casings provided with a front and rear locking recess or shoulder have been described. The arrangement could easily be reversed to provide the ribs on the inner casing.

The cartridge of FIG. 3 no longer has two, but rather three casings, including two primary 41 and secondary 40 inner casings in the outer casing 1 of the cartridge of FIG. 2A, the three casings 1, 40, 41 being snapped onto to each other in pairs like the casings 1 and 5 of the cartridge of FIG. 2A. The casings 40 and 41 have respectively end pieces 42 and 43 shaped like the end piece 6 of the casing 5 of the cartridge of FIG. 2A, with a recess providing a rear-locking shoulder. The secondary inner casing 40 forms an inner casing for the outer casing 1 but an outer casing for the primary inner casing 41 and has, for this purpose, snap-on ribs 44 for the end piece 43 of the primary casing 41.

The casing 41, with a smaller diameter, is referred to as the primary inner casing, not only because it is the smallest, but also because it is the only one which has a disc-shaped rear sealing and thrust wall, the thrust walls on the other casings being annular.

Several multiple-casing cartridges have been described, in this case with two and three casings. Naturally, and in theory, the number of casings which can be snapped onto each other in pairs in any one cartridge is unlimited. Conversely, it is perfectly possible to use only the outer casing, without an inner casing, for the application of a single-constituent product.

The driving assembly 50 shown in FIG. 2B makes it possible to use the double-casing cartridge of FIG. 2A on a conventional gun with a single disc-shaped piston, prefectly known to a man skilled in the art and which need not be described here, with the proviso that the sum of the lengths of the assembly and the cartridge of the invention be substantially equal to the length of the cartridge for which this conventional gun has been designed. For information, however, reference can be made to the document FR-A-79 10957, which, on this point, can therefore be considered as an integral part of the present description. The assembly 50, or double piston, has an annular outer piston 51, for the annular rear wall 4 of the outer casing 1 and is of substantially the same dimensions as the wall 4, and a disc-shaped inner piston 52, for the disc-shaped rear wall 7 of the inner casing 5 and is of substantially the same dimensions as those of the wall 7. The two pistons 51, 52 lie in the same transverse plane, if they can be considered to be planar. The outer piston 51 is carried by a transmission tube 53, at one end of the latter, the other, rear, end of the tube 53 having an annular external flange 54 on which the disc-shaped piston of the application gun is designed to act to drive the assembly 50. The inner piston 52 is also carried by a transmission tube 55, of a smaller diameter than the tube 53, lying inside the latter, and onto which it is snapped, at the rear, in the same way as the casings 1 and 5 of the cartridge. The tube 53 has snap-on ribs 56, identical to the ribs 8 but oriented in the opposite direction, and the tube 55 has an annular recess providing a rear shoulder 57 for receiving the snap-on catches 58 on the ribs 56 and a front shoulder 59 for receiving the claws 60 on the ribs 56.

Thus the two tubes 53, 55 are integral with each other axially and radially, the inner tube 55 being locked to the front by the shoulder 59 and the front claws 60 and, to the rear, by the shoulder 57 and the catches 58 on the ribs 56.

When the disc-shaped piston of the gun pushes the flange 54 of the tube 53, the annular piston 51 pushes the annular wall 4 of the casing 1 to impel the constituent contained in it, and the disc-shaped piston 53, integral in translation with the piston 51, pushes the disc-shaped wall 7 of the casing 5 to impel the constituent contained in it.

Naturally again, it is possible to provide as many thrust pistons, associated with their transmission tubes, snapped onto each other in pairs, as there are casings in the storage and application cartridge.

To change the proportions of the constituents of the application product, it suffices to change the inner casings and thrust pistons.

Cartridge casings snapped onto each other have been described, as well as transmission tubes for pushing the driving assembly also snapped onto each other. The invention could also provide for means not of snapping on but of screwing with, in place of the snap-on ribs, screwing ribs with threaded or tapped portions and, in place of the snap-on recesses, tappings or threads.

Obviously, many modifications and variations of the present invention are possible in light of the above teachings. It is therefore to be understood that within the scope of the appended claims, the present invention may be practiced otherwise than as specifically described herein.

We claim:

1. A tubular cartridge for storing and dispensing a plurality of materials, comprising:

an outer casing for housing a first one of said plurality of materials to be stored and dispensed;

means defined upon a front end portion of said outer casing for supporting a dispensing nozzle for dispensing said first one of said plurality of materials;

plunger means movably disposed within said outer casing between a rearward position and a forward position for causing said first one of said plurality of materials to be dispensed outwardly from said outer casing and through said dispensing nozzle as said plunger means is moved within said outer casing from said rearward position to said forward position;

an inner casing disposed within said outer casing for housing a second one of said plurality of materials to be stored and dispensed;

means defines upon a front end portion of said inner casing for supporting a dispensing nozzle for dispensing said second one of said plurality of materials;

plunger means movably disposed within said inner casing between a rearward position and a forward position for causing said second one of said plurality of materials to be disposed outwardly from said inner casing and through said dispensing nozzle of said inner casing as said plunger means of said inner casing is moved within said inner casing from said rearward position to said forward position;

support means, having front and rear support surfaces, fixedly mounted within said front end portion of said outer casing; and axially spaced front and rear shoulder means, defining an annular recess therebetween, provided upon said front end portion of said inner casing, said rear shoulder means abutting said rear support surface of said support means of said outer casing while said support means of said outer casing is accommodated within said annular recess of said inner casing, and said front shoulder means snap-fittingly engaging said front support surface of said support means of said outer casing so as to fixedly mount said front end portion of said inner casing within said front end portion of said outer casing.

2. A cartridge as set forth in claim 1, wherein:

said support means of said outer casing comprises at least one support rib.

3. A cartridge as set forth in claim 2, wherein;

said at least on support rib comprises four ribs disposed within two perpendicular planes and in diametrically opposite pairs.

4. A cartridge as set forth in claim 2, wherein:

said at least one support rib comprises an integrally molded portion of said outer casing.

5. A cartridge as set forth in claim 2, wherein:

said front support surface of said at least one support rib is disposed upon a front portion of said at least one support rib which is radially movable with respect to said outer casing so as to permit said radially movable front portion of said at least one support rib to move radially outwardly with respect to a longitudinal axis of said outer casing as said inner casing is mounted within said outer casing and to permit said front shoulder means of said front end portion of said inner casing to snap-fittingly engage said front support surface of said at least one support rib as said radially movable front portion of said at least one support rib moves radially inwardly with respect to said longitudinal axis of said outer casing so as to return to its normal non-deflected position after said front shoulder means of said front end portion of said inner casing has passed axially beyond said front support surface of said at least one support rib.

6. A cartridge as set forth in claim 5, wherein:

said at least one support rib has a substantially C-shaped configuration as seen in cross-section.

7. A cartridge as set forth in claim 1, wherein:

said means defined upon said front end portion of said outer casing for supporting said dispensing nozzle comprises an externally threaded portion for threadedly engaging an internally threaded portion of said dispensing nozzle.

8. A cartridge as set forth in claim 1, wherein;

said plunger means of said inner casing has a disc-shaped configuration; and said plunger means of said outer casing has an annular configuration for surrounding said inner casing.

9. A cartridge as set forth in claim 1, wherein:

said front end portion of said inner casing has a substantially D-shaped configuration as seen in cross-reference.

10. A tubular cartridge for storing and dispensing a plurality of materials, comprising:

an outer casing for housing a first one of said plurality of materials to be stored and dispensed;

means defined upon a front end portion of said outer casing for supporting a dispensing nozzle for dispensing said first one of said plurality of materials;

plunger means movably disposed within said outer casing between a rearward position and a forward position for causing said first one of said plurality of materials to be dispensed outwardly from said outer casing and through said dispensing nozzle as said plunger means is moved within said outer casing for said rearward position to said forward position;

at least one inner casing disposed within said outer casing for housing at least an additional one of said plurality of materials to be stored and dispensed;

means defined upon a front end portion of said at least one inner casing for supporting a dispensing nozzle for dispensing said at least an additional one of said plurality of materials;

plunger means movably disposed within said at least one inner casing between a rearward position and a forward position for causing said at least an additional one of said plurality of materials to be dispensed outwardly from said at least one inner casing and through said dispensing nozzle of said at least one inner casing as said plunger means of said at least one inner casing is moved within said at least one inner casing from said rearward position to said forward position;

support means, having front and rear support surfaces, fixedly mounted within said front end portion of said outer casing; and axially spaced front and rear shoulder means, defining an annular recess therebetween, provided upon said front end portion of said at least one inner casing, said rear shoulder means abutting said rear support surface of said support means of said outer casing while said support means of said outer casing is accommodated within said annular recess of said inner casing, and said front shoulder means snap-fittingly engaging said front support surface of said support means of said outer casing so as to fixedly mount said front end portion of said at least one inner casing within said front end portion of said outer casing.

11. A cartridge as set forth in claim 10, wherein:

said support means of said outer casing comprises at least one support rib.

12. A cartridge as set forth in claim 11, wherein:

said at least one support rib comprises four ribs disposed within two perpendicular planes and in diametrically opposite pairs.

13. A cartridge as set forth in claim 11, wherein:

said at least one support rib comprises an integrally molded portion of said outer casing.

14. A cartridge as set forth in claim 11, wherein:

said front support surface of said at least one support rib is disposed upon a front portion of said at least one support rib which is radially movable with respect to a longitudinal axis of said outer casing so as to be deflected radially outwardly away from said longitudinal axis of said outer casing by said front shoulder means of said front end portion of said at least one inner casing as said at least one inner casing is inserted within said outer casing and thereby permit said front shoulder means of said front end portion of said at least one inner casing to snap-fittingly engage said front support surface of said at least one support rib as said radially movable front portion of said at least one support rib moves radially inwardly with respect to said longitudinal axis of said outer casing so as to return to its normal non-deflected position after said front shoulder means of said front end portion of said at least one inner casing has passed axially beyond said front support surface of said at least one support rib.

15. A cartridge as set forth in claim 14, wherein:

said at least one support rib has a substantially C-shaped configuration as seen in cross-section.

16. A cartridge as set forth in claim 10, wherein:

said means defined upon said front end portion of said outer casing for supporting said dispensing nozzle comprises an externally threaded portion for threadedly engaging an internally threadedly portion of said dispensing nozzle.

17. A cartridge as set forth in claim 10, wherein:

said plunger means of said at least one inner casing has a disc-shaped configuration; and said plunger means of said outer casing has an annular configuration for surrounding said inner casing.

18. A cartridge as set forth in claim 10, wherein:

said front end portion of said at least one inner casing has a substantially D-shaped configuration as seen in cross-section.

19. A cartridge as set forth in claim 10, wherein:

said at least one inner casing comprises a pair of coaxially disposed inner casings with a radially outermost one of said inner casings comprising an inner casing with respect to said outer casing, and further comprising an outer casing with respect to a radially innermost one of said pair of inner casings.

20. A cartridge as set forth in claim 19, further comprising:

second support means, having front and rear support surfaces, fixedly mounted within a front end portion of said radially outermost one of said pair of inner casings which comprises an outer casing with respect to said radially innermost one of said pair of inner casings; and axially spaced front and rear shoulder means, defining a second annular recess therebetween, provided upon a front end portion of said radially innermost one of said pair of inner casings, said rear shoulder means of said radially innermost one of said pair of inner casings abutting said rear support surface of said second support means of said radially outermost one of said pair of inner casings while said second support means of said radially outermost one of said pair of inner casings is accommodated within said second annular recess of said radially innermost one of said pair of inner casings, and said front shoulder means of said radially innermost one of said pair of inner casings snap-fittingly engaging said front support surface of said radially outermost one of said pair of inner casings so as to fixedly mount said front end portion of said radially innermost one of said pair of inner casings within said front end portion of said radially outermost one of said pair of inner casings.

* * * * *